United States Patent [19]

Kahn

[11] 4,381,848

[45] May 3, 1983

[54] MEMBRANE CLOSURE STRUCTURE

[75] Inventor: Merle S. Kahn, Richmond, Va.

[73] Assignee: Reynolds Metals Company, Chesterfield County, Va.

[21] Appl. No.: 279,592

[22] Filed: Jul. 1, 1981

[51] Int. Cl.[3] ..... B65D 43/02; B65D 51/20

[52] U.S. Cl. ..... 229/43; 206/525; 206/628; 229/3.5 MF

[58] Field of Search ..... 229/43, 3.5 MF; 206/634, 621, 439, 438, 525, 628; 220/258, 265

[56] References Cited

U.S. PATENT DOCUMENTS

| | | | |
|---|---|---|---|
| 2,954,116 | 9/1960 | Maso et al. | 206/56 |
| 3,256,981 | 6/1966 | Kurtz | 206/56 |
| 3,335,939 | 8/1967 | Robinson, Jr. | 229/43 |
| 3,454,210 | 7/1969 | Spiegel et al. | 229/43 |
| 3,511,436 | 5/1970 | Kessler | 229/66 |
| 3,625,351 | 12/1971 | Eisenberg | 206/56 AA |
| 3,650,386 | 3/1972 | Tigner | 206/46 F |
| 3,655,503 | 4/1972 | Stanley et al. | 229/48 T |
| 3,854,653 | 12/1974 | Engelsberger | 229/51 R |
| 3,946,871 | 3/1976 | Sturm | 206/498 |
| 3,946,872 | 3/1976 | Sturm | 206/498 |

FOREIGN PATENT DOCUMENTS 1536428 12/1978 United Kingdom .

*Primary Examiner*—William T. Dixson, Jr.
*Assistant Examiner*—Gary E. Elkins
*Attorney, Agent, or Firm*—Lyne, Girard & McDonald

[57] ABSTRACT

A retortable membrane closure structure for containers is disclosed which includes a first adhesive layer, an intermediate layer, a second adhesive layer and an outer barrier layer. Bond strengths and tear strengths of the layers are selected such that upon peeling the membrane from a container to which it was sealed initial failure occurs within the intermediate layer, followed by failure between the second adhesive layer and the intermediate layer, providing a clean peel between the layers.

10 Claims, 6 Drawing Figures

MEMBRANE CLOSURE STRUCTURE

BACKGROUND OF THE INVENTION

Disposable retortable containers are typically formed from either metallic foils, such as aluminum foil, or plastics resins. These containers include a lip portion outwardly extending in a generally horizontal direction along the top opening thereof, providing a sealing region for a closure element.

Membrane closure elements for such retortable containers are also known. Typically, these membranes are heat and/or adhesively bonded to the lip of the container. The seal between the membrane and the container must be capable of withstanding the retort sterilization process, which process occurs in the presence of steam and/or water at temperatures of 250° F. (121° C.) and higher. In order to accomplish this, the membranes in the past have required seal strengths such that peeling of the membrane from the container by hand was impossible.

Attempts have been made to provide a peelable membrane structure. Thus, U.S. Pat. Nos. 3,946,871 and 3,946,872 describe membranes in which the seal between an aluminous metal layer and a plastics resin layer is peeled by breaking of the plastics resin layer. Although it is stated in these patents that such a membrane is retortable, it has been found that the failure rates for these containers during retorting is unacceptably high.

It is thus a primary object of the present invention to provide a peelable membrane structure for containers which can consistently successfully withstand the retort sterilization process.

THE PRESENT INVENTION

By means of the present invention, these objectives are obtained.

The membrane structure of the present invention comprises a first adhesive layer which is heat sealed to the flange or lip of the container, an intermediate layer formed of a thin metallic foil or tissue paper, a second adhesive layer, and an outer barrier layer. The intermediate layer has a tear strength less than the bond strength between the first adhesive layer and the container and less than the bond strength of the second adhesive layer to the intermediate layer and the outer barrier layer. Thus, upon peeling of the membrane from the container, the intermediate layer fails, rather than either of the adhesive layers, resulting in a peelable bond which may withstand retorting.

Optionally, additional layers, such as an additional adhesive layer and a reverse-printed film layer may be provided over the outer barrier layer, to produce desired protective and/or decorative effects to the structure.

BRIEF DESCRIPTION OF THE DRAWINGS

The membrane structure of the present invention will be more fully described with respect to the drawings in which.

DETAILED DESCRIPTION OF THE PREFERRED EMBODIMENTS

Figure 1:
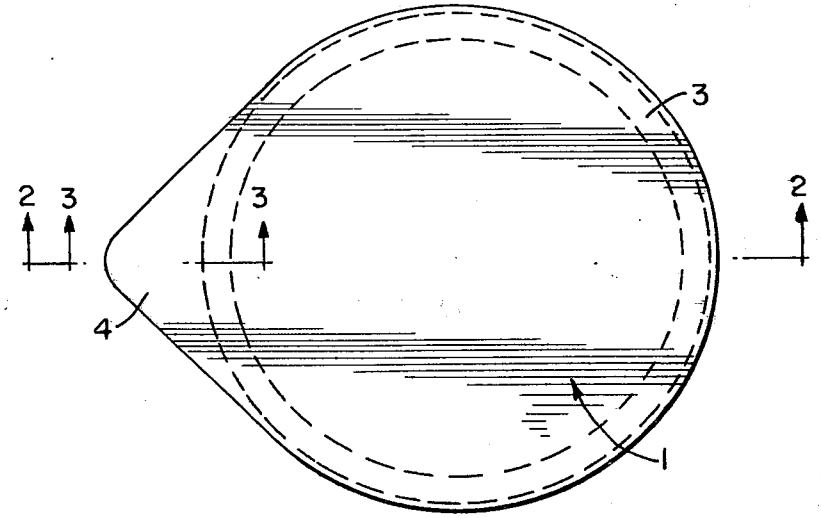
FIG. 1 is a top elevational view of a container having the membrane structure of the present invention sealed thereon.
Figure 2:
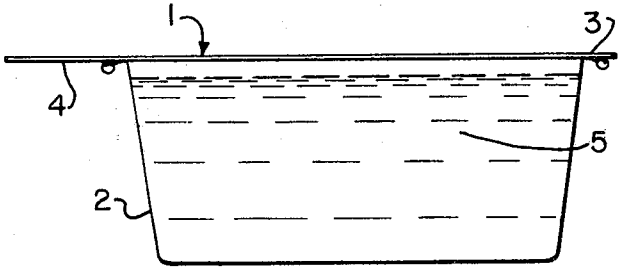
FIG. 2 is a cross-sectional view of the membrane and container taken along line 2—2 of FIG. 1.
Figure 4:
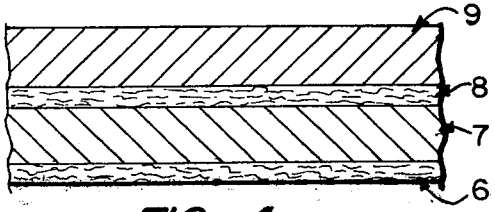
FIG. 4 is a partial cross-sectional view of the membrane structure.
Figure 3:
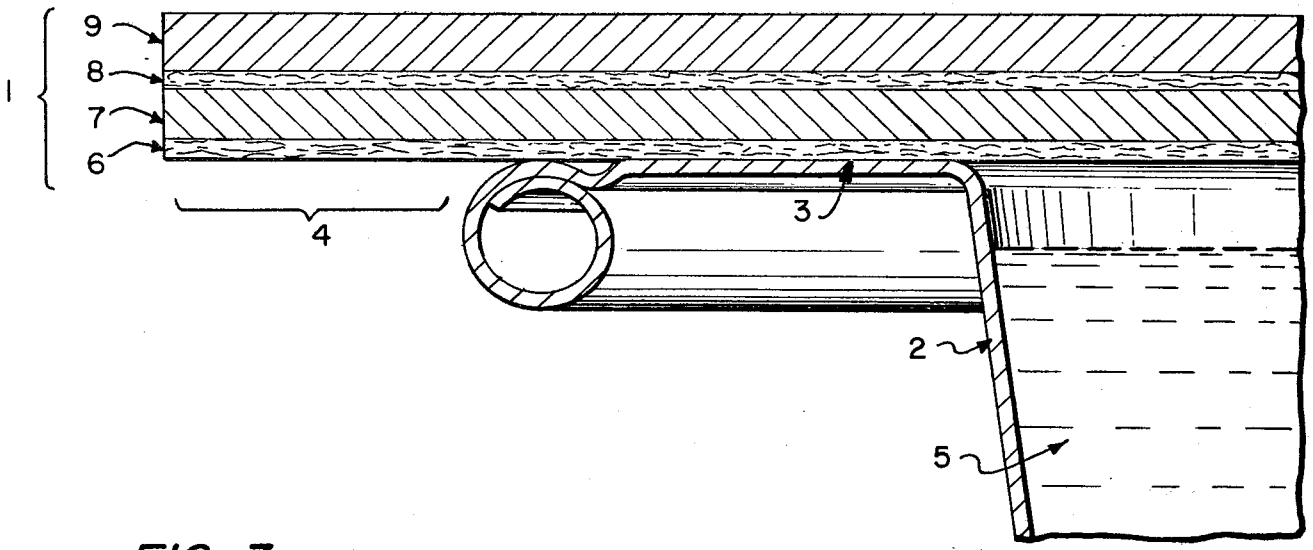
FIG. 3 is an exploded cross-sectional view of a portion of the container and membrane, taken along line 3—3 of FIG. 1.

Turning to the FIGURES, FIGS. 1 and 2 illustrate a membrane 1 which has been heat sealed to the lip or rim portion 3 of a container 2. The rim portion 3 of container 2 is generally flat and includes a sufficient width thereto to provide a satisfactory heat seal of the membrane 1 to the container 2.

The container 2 may be formed of a plastics resin material or a metallic foil, such as aluminous metal foil, and, if formed of a metallic foil or a nonheat-sealable plastics resin, includes, at least on the rim portion 3 thereof, a coating or layer of a heat-sealable plastics resin material, such as polypropylenes, polyvinyl chlorides, polyethylenes, polyesters or nylons.

The membrane 1 includes a first adhesive layer 6, which adhesive layer 6 may be formed of any of the same materials used to form the coating or laminate upon rim 3. Thus, a heat seal can be formed between rim 3 and adhesive layer 6, due to the compatability and heat-sealable nature of the materials covering rim 3 and comprising layer 6. The coating or laminate on the flange 3 may have a thickness of about 0.001 inch (0.00254 cm) and the first adhesive layer 6 of membrane 1 may be produced by coating an amount of about 3 pounds per ream (0.005 kilograms per square meter) onto intermediate layer 7.

The intermediate layer 7 has coated on the other side thereof a second adhesive layer 8. Adhesive layer 8 has a bond strength between it and intermediate layer 7 and between it and barrier layer 9 which is less than the bond strength between adhesive layer 6 and rim 3 of container 2 but greater than the tear strength of intermediate layer 7. Typical plastics resin materials which may be employed to form this adhesive layer 8 include vinyls, polyesters, epoxies, ethylene vinyl acetates and polypropylene dispersions, such as Morprime®.

The intermediate layer 7, as previously mentioned, is formed from a low tear strength material, having a tear strength lower than the adhesive strengths of layers 6 and 8. The intermediate layer 7 may be formed of a thin metallic foil, such as 0.0005 inch (0.00127 cm) aluminum foil, or tissue paper. These materials are chosen, rather than plastics resin films, to enable the composite container to withstand retorting.

The outer barrier layer 9 may also be formed from aluminum foil or paper, for the same retort withstanding reasons as with respect to layer 7. However, layer 9 is chosen for its high tear strength, which tear strength is greater than the tear strength of intermediate layer 7 and greater than the bond strengths of adhesive layers 6 and 8.

Figure 6:
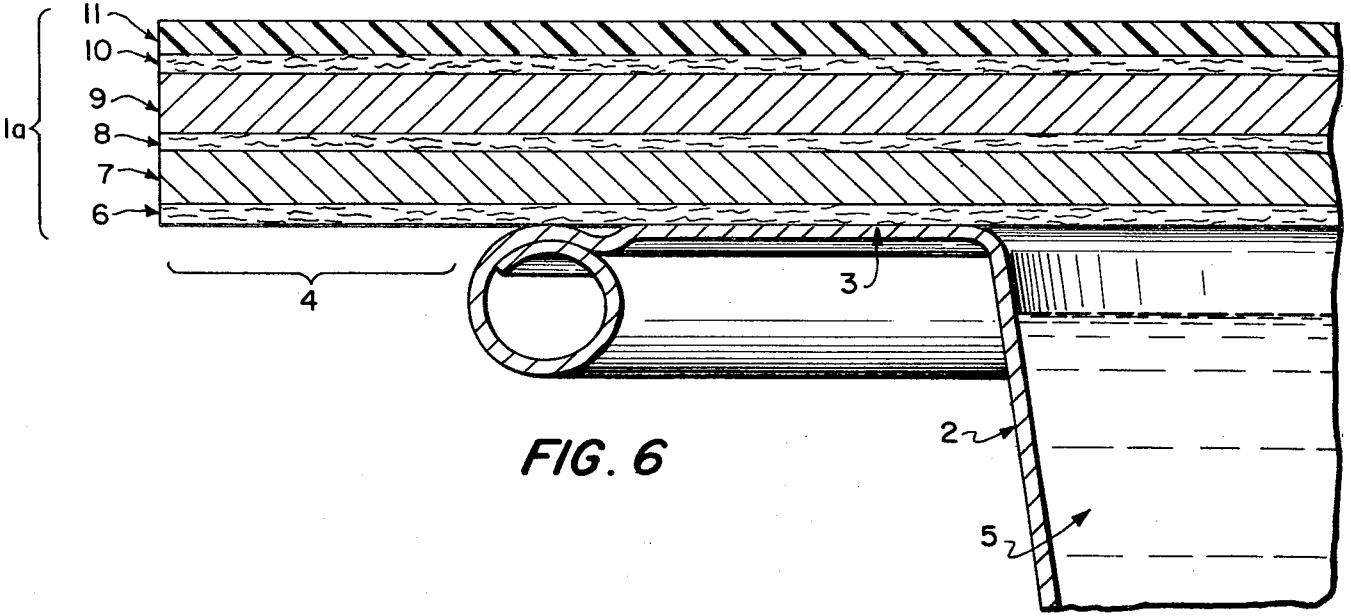
FIG. 6 is an exploded cross-sectional view of a portion of the container and a modified membrane.

Optional additional layers, as shown in the modified membrane 1*a* in FIG. 6, such as a plastics resin film 11, which may be a reverse-printed film, such as a polyester film, may be adhesively bonded by means of adhesive layer 10 to the exposed surface of layer 9, for protective or decorative effects. However, such additional layers play no part in the function of the membrane, as far as the ability of the membrane to withstand retorting and provide a peelable seal are concerned.

Figure 5:
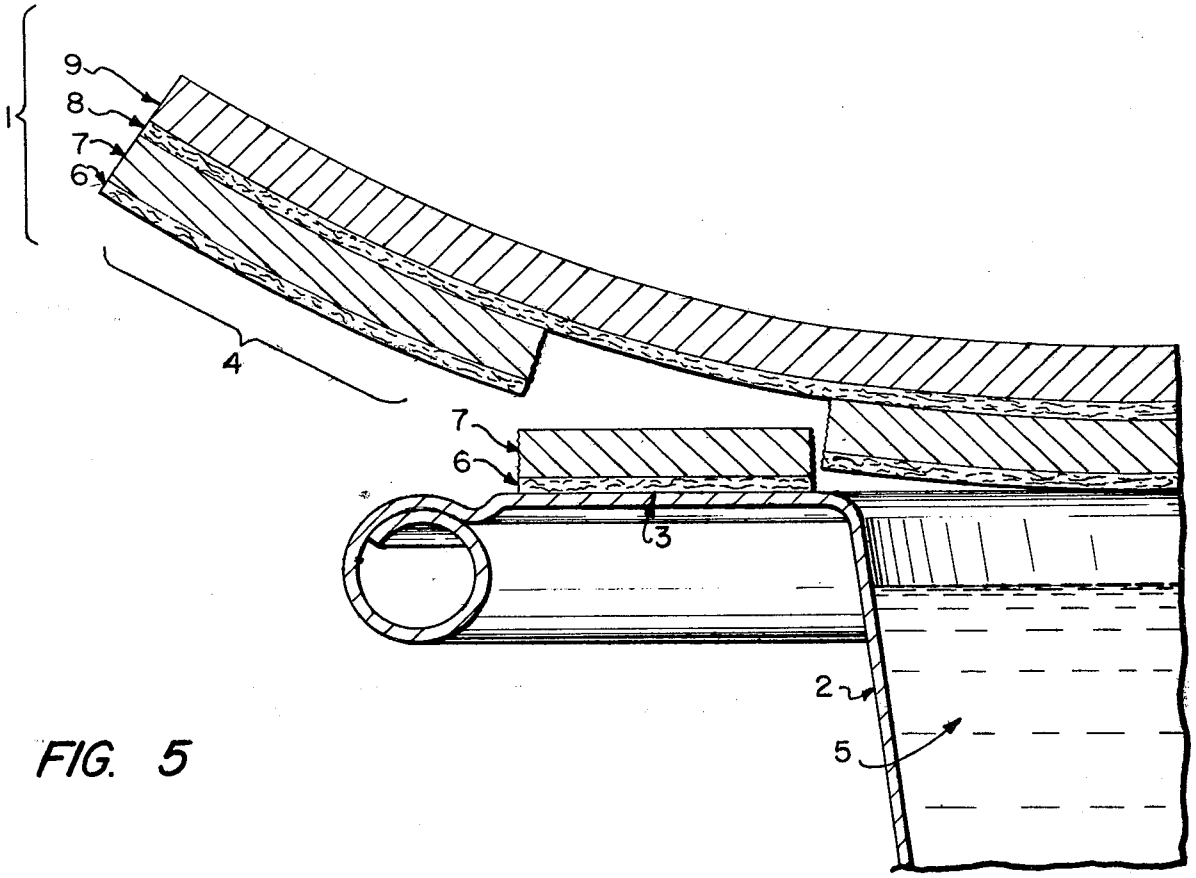
FIG. 5 is an exploded cross-sectional view of the portion of the membrane and container shown in FIG. 3 after fracture of the intermediate layer.

The operation of the membrane structure is best shown in FIG. 5. As extended tab 4 of membrane 1 is raised, shearing forces are placed upon the layers 6, 7, 8, and 9. As previously mentioned, the tear strength of intermediate layer 7 is less than the bond strength of layers 6 and 8, thus, initial failure occurs within intermediate layer 7 rather than at an adhesive bond. Once this failure has occurred, the failed portion of intermediate layer 7 will remain adhered to adhesive layer 6, rather than adhesive layer 8, since the bond strength of adhesive layer 6 to rim 3 is in excess of the bond strength of adhesive layer 8 to intermediate layer 7. That portion of adhesive layer 8 which was previously adhered to the fractured portion of intermediate layer 7 remains attached to barrier layer 9, rather than intermediate layer 7, since its internal tear strength exceeds its bond strength. Thus, the heat sealed portion of layer 6 to rim 3 and the fractured portion of intermediate layer 7 adhered to layer 6 remain on rim 3 as the remainder of the membrane 1 is torn away, exposing material 5 contained within container 2.

EXAMPLE

An aluminum container having the general configuration as shown in FIG. 2 and having a thickness of 0.005 inch (0.00127 cm) was formed with a 0.001 inch (0.025 cm) cast polypropylene layer on the surface of rim 3, as well as coating the entire interior of the container 2. A membrane 1, having the general configuration as shown in FIG. 1 was formed having a first adhesive layer 6 formed of a 3 pound per ream (0.005 kilogram per square meter) polypropylene coating, an intermediate layer of 0.005 inch (0.00127 cm) aluminum foil, a second adhesive layer of 1 pound per ream (0.0016 kilogram per square meter) polypropylene and a barrier layer 9 of 0.0015 inch (0.00381 cm) aluminum foil. The membrane also included a 2 pound per ream (0.0032 kilogram per square meter) polyester adhesive layer and a 0.0048 inch (0.0122 cm) reverse-printed polyester film covering barrier layer 9.

The container was heat sealed under 1268 pounds (575.16 kilograms) of pressure and at a temperature of 550° F. (282° C.) and retorted at a temperature of 250° F. (120° C.).

Upon raising tab 4 and peeling membrane 1 under hand pressure, clean internal tear of intermediate layer 7 along the heat seal of the membrane 1 with rim 3 occurred, with the heat sealed portion of adhesive layer 6 and the fracture portion of intermediate layer 7 remaining attached to the rim 3 of container 2 and the remainder of the membrane 1 being removed from the container 2.

From the foregoing, it is clear that the present invention provides a membrane which is both peelable and retortable.

While the present invention has been shown with respect to certain specific embodiments thereof, it is not intended to be so limited thereby, except as set forth in the following claims.

I claim:

1. A membrane closure for a container, said membrane closure being heat sealable to said container, said membrane closure being capable of removal from said container by peeling under hand pressure and said membrane closure being capable of withstanding retort sterlization, said membrane closure comprising a first adhesive layer, an intermediate metallic foil or paper layer having one side thereof bonded to said first adhesive layer, a second adhesive layer having one side thereof bonded to the other side of said intermediate layer and a barrier metallic foil or paper layer having one side thereof bonded to the other side of said second adhesive layer, said intermediate layer having a tear strength less than the bond strengths of said first adhesive layer and said second adhesive layer, said second adhesive layer having a bond strength less than the bond strength of said first adhesive layer and said barrier layer having a tear strength greater than the tear strength of said intermediate layer and greater than the bond strengths of said first adhesive layer and said second adhesive layer, whereby upon peeling of said membrane closure from said container initial failure occurs within said intermediate layer and secondary failure occurs between said second adhesive layer and said intermediate layer, along a heat seal between said membrane closure and said container.

2. The membrane closure of claim 1 wherein said intermediate layer and said barrier layer are aluminum foil layers.

3. The membrane closure of claim 1 wherein said first adhesive layer is selected from the group consisting of polypropylenes, polyvinyl chlorides, polyethylenes, polyesters and nylons.

4. The membrane closure of claim 1 wherein said second adhesive layer is selected from the group consisting of vinyls, polyesters, epoxies, ethylene vinyl acetates and polypropylene dispersions.

5. The membrane closure of claim 1 further comprising a third adhesive layer having one side thereof bonded to the other side of said barrier layer and an outer layer having one side thereof bonded to the other side of said third adhesive layer.

6. The membrane closure of claim 5 wherein said third adhesive layer is a polyester adhesive.

7. The membrane closure of claim 5 wherein said outer layer is a plastics resin film.

8. The membrane closure of claim 5 wherein said outer layer is a reverse-printed plastics resin film.

9. The membrane closure of claim 5 wherein said outer layer is a polyester film.

10. The membrane closure of claim 5 wherein said outer layer is a reverse-printed polyester film.

* * * * *